US006421934B2

(12) United States Patent
Graf

(10) Patent No.: US 6,421,934 B2
(45) **Date of Patent: *Jul. 23, 2002**

(54) SKATE BOOT AND GETTING UP AID FOR SUCH A SKATE BOOT

(75) Inventor: Karl Graf, Kreuzlingen (CH)

(73) Assignee: Graf Skates AG, Kreuzlingen (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/392,996

(22) Filed: Sep. 9, 1999

(30) Foreign Application Priority Data

Sep. 9, 1998 (CH) ..... 1844/98

(51) Int. Cl.[7] ..... A43B 5/00
(52) U.S. Cl. ..... 36/115; 36/72 R
(58) Field of Search ..... 36/115, 131, 3 A, 36/72 R, 45

(56) References Cited

U.S. PATENT DOCUMENTS

| | | | | | |
|---|---|---|---|---|---|
| 2,179,942 | A | * | 11/1939 | Lyne | 36/127 |
| 3,509,646 | A | * | 5/1970 | Vietas | 36/115 |
| 3,806,145 | A | * | 4/1974 | Czeiszperger | 280/811 |
| 4,351,537 | A | * | 9/1982 | Seidel | 36/115 |
| 4,453,727 | A | * | 6/1984 | Bourque | 280/11.12 |
| 4,509,276 | A | * | 4/1985 | Bourque | 36/115 |
| 4,783,911 | A | * | 11/1988 | Brown | 36/115 |
| 4,835,885 | A | * | 6/1989 | Hoshizaki et al. | 36/115 |
| 5,234,230 | A | * | 8/1993 | Crane et al. | 280/811 |
| 5,456,495 | A | | 10/1995 | McLeod | 280/811 |
| 5,498,033 | A | * | 3/1996 | Hoshizaki et al. | 280/841 |
| 5,528,841 | A | * | 6/1996 | Pozzobon | 36/115 |
| 5,852,884 | A | * | 12/1998 | Miotto | 36/115 |
| 5,875,569 | A | * | 3/1999 | Dupree | 36/103 |

FOREIGN PATENT DOCUMENTS

| | | | |
|---|---|---|---|
| CA | 2136654 | 5/1996 | A63C/1/00 |
| DE | 566982 C | 1/1932 | 71/11 |
| WO | 96/31137 | * 10/1996 | |

* cited by examiner

*Primary Examiner*—Mickey Yu
*Assistant Examiner*—Jila M. Mohandesi
(74) *Attorney, Agent, or Firm*—Cooper & Dunham LLP; Donald S. Dowden

(57) ABSTRACT

A domed protrusion is foreseen at the inner instep side of the shell of a skate boot which facilitates the getting up of the skater from a sidewise splits. Such a skate boot is specifically suitable as ice-hockey goalkeeper's skate boot.

14 Claims, 1 Drawing Sheet

FIG. 1
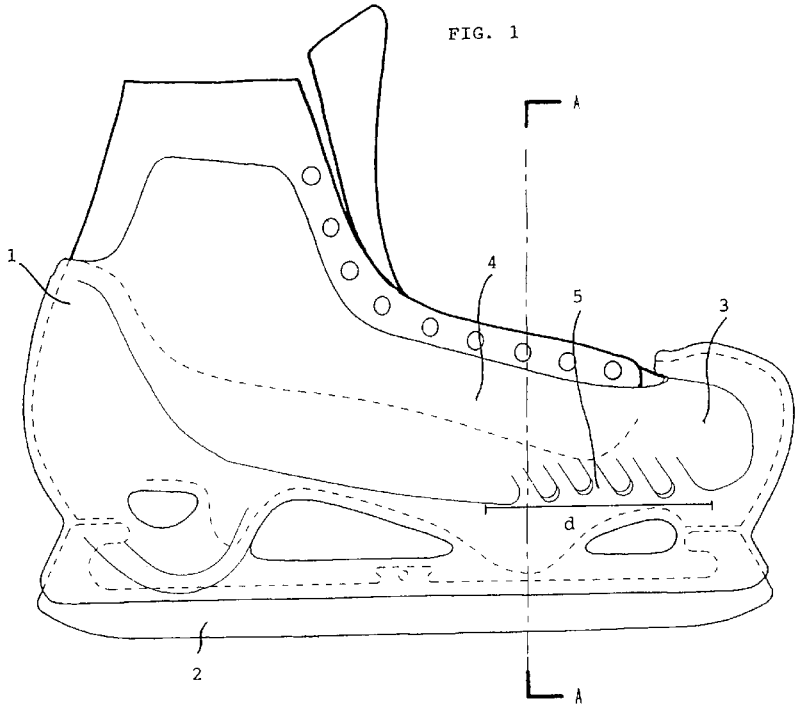
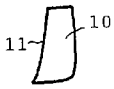
FIG. 3
FIG. 2
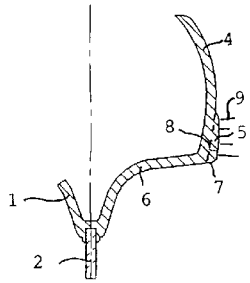

SKATE BOOT AND GETTING UP AID FOR SUCH A SKATE BOOT

BACKGROUND OF THE INVENTION

1. Field of the Invention

The present invention relates to a skate boot. The invention relates also to a shell for a shell skate boot and to a getting up aid for a skate boot.

2. Description of the Prior Art

Skate boots are known to come in various designs. Specifically known are ice-hockey goalkeeper's skate boots because they generally include a boot leg having a lesser height than that of skate boots of the rest of a team. These skate boots can feature a known, conventional boot design or an also known design as shell boot having an outer shell of a plastic material and including an inner liner boot.

One defensive movement of the ice-hockey goalkeeper against shots on the goal is a movement called in the professional language of goalkeepers "Butterfly". The shanks of the goalkeeper are, thereby, spread out sidewise and the skate boots lie at their inner instep side surface partly on the ice and the blades are positioned at a large acute angle relative to the ice or have no contact with the ice at all. This poses for the goalkeeper problems when he wants to change to a different defensive position or back to his normal position. Figure-skating ice skaters, when getting up from a similar position, e.g. from a sidewise part or also complete splits, can encounter for mentioned reason the same problems, too.

SUMMARY OF THE INVENTION

Hence, a general object of the present invention is to provide a skate boot which enables specifically a goalkeeper to get up in a most easy way from a butterfly position, and where applicable eases also for a figure-skater the getting up from a sidewise splits.

A further object is to provide a skate boot having at least one domed protrusion at the outer surface of its inner side.

Due to the fact that a domed protrusion is foreseen at the outer surface of the inner instep, thus, of the surface which faces the ice at the sidewise splits a different position of the ice skate relative to the ice is effected, such that the angle between the blade and the surface of the ice is less acute, or that the blade has a better contact with the ice, respectively, than in case of a skate boot having the conventional extent of its outer shape without an added domed protrusion. This improved contact with the ice facilitates the getting up, so that the domed protrusion forms a getting up aid for the rising from a specific position.

A further object of the invention is to provide a shell for a skate boot which allows a more facilitated rising from the "butterfly" position.

Still a further object is to provide a shell for a shell skate boot at which at least one domed protrusion is foreseen at the outer surface of its inner instep.

The domed protrusion is preferably adjacent the sole area of the skate boot or shell, respectively, because of such a position it can be dimensioned smaller for achieving the same effect than as it would be when it would be arranged further up in the area of the boot upper.

Yet a further object of the invention is to provide a getting up aid for a skate boot which at the above described position lessens or avoids the stated difficulties when getting up.

Still a further object is to provide a getting up aid, especially for an ice-hockey goalkeeper's skate boot which includes a body which is adapted to form a domed protrusion at the skate boot and is adapted to be mounted at the outer surface of the inner instep of the upper material or to the area of the sole.

Because the getting up aid is designed for a mounting to the outer surface of the inner instep area of the boot, it is possible to obtain with same the same effect regarding an improved angular position of the boot in that the body of the getting up aid at the boot forms the respective domed protrusion.

BRIEF DESCRIPTION OF THE DRAWINGS

The invention will be better understood and objects other than those set forth above will become apparent when consideration is given to the following detailed description thereof. Such description makes reference to the annexed drawings where:

FIG. 1 is a side view of a shell skate boot;

FIG. 2 is a view of a section of a part of the shell shown in FIG. 1;

FIG. 3 illustrates a body which is adapted to be mounted to a skate boot.

DETAILED DESCRIPTION OF THE PREFERRED EMBODIMENTS

FIG. 1 illustrates a side view of an ice-hockey skate boot such as worn by goalkeepers. The shell 1 with the blade 2 is, thereby, illustrated in a side view and the inner boot for making up the entire boot and which is set into the shell is only schematically illustrated. The design of a skate boot as a shell boot with the shell 1 of a plastic material and with an inner boot is well-known and must not be illustrated more elaborately. The side view of the shell is selected here in such a fashion, that a view of the inner instep is shown, i.e. it is that side of the shell is shown, which at a normal parallel orientation of the feet faces the other boot. The shell is equipped with a domed protrusion 5 which, in the illustrated example, extends roughly in the area which extends from the cap area 3 of the boot to the boot upper area 4 of the skate boot. The domed protrusion 5 could also be arranged at a different location of the shell 1 or boot, respectively, e.g. extending further back to the heel area or in form of a plurality of individual domed protrusions arranged between the cap area and the heel area. The domed protrusion 5 is, however, preferably arranged at the lower area adjacent the sole of the shell or the skate boot, respectively.

FIG. 2 illustrates a section through the shell along line A—A of FIG. 1, whereby only a part of the shell 1 is shown in the illustrated section. Again visible is the blade 2 and now also the sole 6 of the shell. FIG. 2 discloses how the domed protrusion 5 is formed as a part of the shell in that the plastic material of the shell is pulled out over the normal outer contour of a conventional boot, such as illustrated by the broken line 8. To this end in the illustrated example the sole area has been lengthened outwards by a portion 7 and the domed protrusion section 5 extends still further up into the area of the upper 4.

Obviously, the illustrated preferred embodiment in which the domed protrusion 5 is formed by the material of the shell itself is to be understood as an example only. The domed protrusion 5 could also be formed by a part mounted on the shell as an additional, separate element. This part can consist e.g. of rubber, a plastic material or of a metal and can be mounted to the shell 1 by an arbitrary mounting means. Such a part, such as illustrated as an example in FIG. 3, can also be mounted as body 10 to an existing skate boot and form at the boot a getting up aid with the same effect as the domed protrusion 5 illustrated in the example which is arranged already during the manufacturing of the skate boot and which also can be defined as getting up aid. The mounting of the body 10 which includes a surface 11 adapted to the shape of the boot can be effected by a glueing and/or screwing on or a rivetting.

The domed protrusion can obviously also be arranged at a skate boot which has not been produced as a shell design but rather as a conventional boot design. In this case the domed protrusion is formed preferably by the already mentioned placing of a separate element onto the normal outer contour of the boot, could, however, also be formed by the outer material of the boot itself.

The shape of the domed protrusion 5 and its dimensions can be varied within a broad range. The further the domed protrusion juts out, the larger the standing up effect for the boot will be when the upper area 4 rests on the ice. A preferred range of the projecting of the domed protrusion over the normal contour of a conventional boot or a conventional shell, respectively, lies in the range of 4 millimeters to 2 centimeters when the domed protrusion is located directly adjacent the sole area. If the domed protrusion is arranged further up on the boot, it must be dimensioned correspondingly larger in order to obtain the same standing up effect. The domed protrusion can also be mounted to the sole and can extend from the sole below the area of the upper and/or cap outwards. The shape of the domed protrusion may be semi-circular, oval or cornered, such as illustrated in the Figure. The domed protrusion may also be equipped with gripping elements 9 such as e.g. prongs or pins which enable the boot to penetrate into the ice of the ice surface at the area of the domed protrusion. This can also be of help when getting up from the "butterfly" position.

While there are shown and described present preferred embodiments of the invention, it is to be distinctly understood that the invention is not limited thereto, but may be otherwise variously embodied and practiced within the scope of the following claims.

What is claimed is:

1. A goalkeeper ice-hockey skate boot with a shell, the shell comprising a sole, a blade fixed on said sole, and an upper connected to said sole and having a cap section, a heel section and an intermediate section, wherein said shell has an inside adapted to face towards another like shell and comprises on its inside at least one protrusion of one-piece construction with said upper adjacent said sole, extending only over a part of said shell in spaced-apart relation to said heel section, and protruding from the normal outer contour of said shell upper by providing a greater thickness of said boot upper at said protrusion adjacent said sole, whereby said protrusion increases the angle between said blade and the ice surface when said shell is tilted and rests on said ice surface with the blade edge and said protrusion.

2. The skate boot of claim 1, wherein said protrusion projects by a distance in the range of about 4 millimeters to about 2 centimeters over any adjacent surface.

3. The skate boot of claim 1, wherein said protusion is formed by a shell mounted to an outer material of the boot.

4. The skate boot of claim 1, wherein elements having points adapted to penetrate into ice are arranged at said protusion.

5. A shell for a shell-type goalkeeper ice-hockey skate boot, the shell comprising a sole, a blade fixed on said sole, and an upper having a cap section, a heel section and an intermediate section, wherein said shell has an inside adapted to face towards another like shell and comprises on its inside at least one protrusion of one-piece construction with said upper adjacent said sole, extending only over a part of said shell in spaced-apart relation to said heel section, and protruding from the normal outer contour of said shell upper by providing a greater thickness of said shell upper at said protrusion adjacent said sole, whereby said protrusion increases the angle between said blade and the ice surface when said shell is tilted and rests on said ice surface with the blade edge and said protrusion.

6. The shell of claim 5, wherein said protusion projects by a distance in the range of about 4 millimeters to about 2 centimeters over any adjacent surface.

7. The skate boot of claim 5, wherein said protrusion is formed by a portion of the material of the shell.

8. The shell of claim 5, wherein said protusion is formed by an attachment mounted to the material of the shell.

9. The shell of claim 5, wherein elements having points adapted to penetrate into ice are arranged at said protusion.

10. An adapter in combination with a goalkeeper ice-hockey skate boot with a shell or a figure skate boot with a shell, said shell comprising a sole, a blade fixed on said sole, and an upper having a cap section, a heel section and an intermediate section, wherein said adapter is provided with a first curved section formed to fit on the surface of said upper adjacent said sole, extending only over a part of said shell in spaced-apart relation to said heel section, and a second section forming a protrusion of one-piece construction with said upper when said adapter is in place, said protrusion protruding from the normal outer contour of said shell upper by providing a greater thickness of said shell upper at said protrusion adjacent said sole, whereby said protrusion increases the angle between said blade and the ice surface when said shell is tilted and rests on said ice surface with the blade edge and said protrusion.

11. A figure skate boot with a shell, the shell comprising a sole, a blade fixed on said sole, and an upper having a cap section, a heel section and an intermediate section, wherein said shell has an inside adapted to face towards another like shell and comprises on its inside at least one protrusion of one-piece construction with said upper adjacent said sole, extending over a part of said shell in spaced-apart relation to said heel section, and protruding from the normal outer contour of said shell upper by providing a greater thickness of said shell upper at said protrusion adjacent said sole, whereby said protrusion increases the angle between said blade and the ice surface when said shell is tilted and rests on said ice surface with the blade edge and said protrusion.

12. A pair of goalkeeper ice-hockey or figure skate boots with respective shells, each shell comprising a sole, a blade fixed on said sole, and an upper having a cap section, a heel section and an intermediate section, wherein each of said shells has an inside adapted to face towards another like shell and comprises on its inside at least one protrusion of one-piece construction with said upper adjacent said sole, extending only over a part of said shell in spaced-apart relation to said heel section, and protruding from the normal outer contour of said shell upper by providing a greater thickness of said shell upper at said protrusion adjacent said sole, whereby said protrusion increases the angle between said blade and the ice surface when said shell is tilted and rests on said ice surface with the blade edge and said protrusion.

13. A goalkeeper ice-hockey skate boot without a shell, the boot comprising a sole, a blade fixed on said sole, and an upper connected to said sole and having a cap section, a heel section and an intermediate section, wherein said boot has an inside adapted to face towards another like boot and comprises on its inside at least one protrusion of one-piece construction with said upper adjacent said sole, extending only over a part of said boot in spaced-apart relation to said heel section, and protruding from the normal outer contour of said boot upper by providing a greater thickness of said shell upper at said protrusion adjacent said sole, whereby said protrusion increases the angle between said blade and the ice surface when said boot is tilted and rests on said ice surface with the blade edge and said protrusion.

14. The skate boot of claim 13, wherein said protusion is formed by a portion of an outer material of the boot.

* * * * *